US006988473B2

(12) United States Patent
Rohe et al.

(10) Patent No.: US 6,988,473 B2
(45) Date of Patent: Jan. 24, 2006

(54) VARIABLE VALVE ACTUATION MECHANISM HAVING AN INTEGRATED ROCKER ARM, INPUT CAM FOLLOWER AND OUTPUT CAM BODY

(75) Inventors: Jeffrey D. Rohe, Caledonia, NY (US); Fuat Koro, Rochester, NY (US); David J. Trapasso, Bloomfield, NY (US); Thomas H. Fischer, Rochester, NY (US); Richard B. Roe, Henrietta, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/606,884

(22) Filed: Jun. 26, 2003

(65) Prior Publication Data

US 2004/0261737 A1 Dec. 30, 2004

(51) Int. Cl.
*F01L 1/34* (2006.01)

(52) U.S. Cl. ..... 123/90.16; 74/53; 74/567; 74/569; 123/90.15

(58) Field of Classification Search .. 123/90.15–90.18, 123/90.39–90.59, 508; 74/55, 569, 53, 54, 74/567

See application file for complete search history.

(56) References Cited

U.S. PATENT DOCUMENTS 5,184,452 A * 2/1993 Stahlecker et al. ..... 57/105
5,540,207 A * 7/1996 Absenger ..... 123/508
5,937,809 A 8/1999 Pierik et al.
5,957,673 A * 9/1999 Kampichler et al. ..... 417/437
5,983,032 A * 11/1999 Miyamoto ..... 396/83
6,058,895 A * 5/2000 Hermsen ..... 123/90.16
6,092,497 A * 7/2000 Preston et al. ..... 123/90.16
6,131,545 A * 10/2000 Kreuter ..... 123/198 F
6,257,201 B1 * 7/2001 Kajiura et al. ..... 123/321
6,273,040 B1 * 8/2001 Curtis ..... 123/90.16
6,571,782 B2 6/2003 Brosseau et al.
6,584,943 B1 * 7/2003 Klotz ..... 123/90.16
6,588,387 B2 * 7/2003 Cecur ..... 123/90.46
6,595,172 B2 7/2003 Kabasin et al.
6,705,264 B2 * 3/2004 Onoue ..... 123/90.39
2001/0052329 A1 * 12/2001 Himsel ..... 123/90.16

* cited by examiner

*Primary Examiner*—Thomas Denion

*Assistant Examiner*—Jaime Corrigan

(74) *Attorney, Agent, or Firm*—Patrick M. Griffin

(57) ABSTRACT

A variable valve actuation mechanism includes a control shaft assembly and a body. The control shaft assembly is pivotable relative to a pivot axis. The body is pivotally disposed on the control shaft assembly, and includes an input cam follower and at least one output cam surface. The input cam follower engages an input cam lobe, and the output cam surface engages a corresponding output cam follower. A spring engages the body and biases the input cam follower into engagement with the input cam lobe.

21 Claims, 8 Drawing Sheets

VARIABLE VALVE ACTUATION MECHANISM HAVING AN INTEGRATED ROCKER ARM, INPUT CAM FOLLOWER AND OUTPUT CAM BODY

TECHNICAL FIELD

The present invention relates to variable valve actuating mechanisms.

BACKGROUND OF THE INVENTION

Modern internal combustion engines may incorporate advanced throttle control systems, such as, for example, intake valve throttle control systems, to improve fuel economy and performance. Generally, intake valve throttle control systems control the flow of gas and air into and out of the engine cylinders by varying the timing and/or lift (i.e., the valve lift profile) of the cylinder valves in response to engine operating parameters, such as engine load, speed, and driver input. For example, the valve lift profile is varied from a relatively high-lift profile under high-load engine operating conditions to a reduced/lower low-lift profile under engine operating conditions of moderate and low loads.

Intake valve throttle control systems vary the valve lift profile through the use of various mechanical and/or electromechanical configurations, collectively referred to herein as variable valve actuation (VVA) mechanisms. Several examples of particular VVA mechanisms are detailed in commonly-assigned U.S. Pat. No. 5,937,809, the disclosure of which is incorporated herein by reference. Generally, a conventional VVA mechanism includes a rocker arm that carries a cam follower. The cam follower engages an input cam of a rotary input shaft, such as the engine camshaft. The cam follower and thus the rocker arm are displaced in a generally radial direction by the input cam, and a pair of link arms transfers the displacement of the rocker arm to pivotal oscillation of a pair of output cams relative to the input shaft or camshaft. Each of the output cams is associated with a respective valve. The pivotal oscillation of the output cams is transferred to actuation of the valves by associated cam followers, such as, for example, direct acting cam followers or roller finger followers. One or more return springs biases the rocker arm cam follower into engagement with the input cam lobe.

A desired valve lift profile is obtained by orienting the output cams in a starting or base angular orientation relative to the cam followers and/or the central axis of the input shaft. The starting or base angular orientation of the output cams determines the portion of the lift profile thereof that engages the cam followers as the output cams are pivotally oscillated, and thereby determines the valve lift profile. The starting or base angular orientation of the output cams is set via a control shaft that pivots a pair of frame members which, via the rocker arm and link arms, pivot the output cams to the desired base angular orientation.

Typically, the frame members and output cams of a conventional VVA mechanism are pivotally disposed upon the engine input or camshaft. Thus disposed, the frame members and output cams impose parasitic loads upon the driving torque of the engine input/camshaft. Such parasitic loads reduce engine power and fuel efficiency. Further, since the rocker arm is connected via the link arms to the output cams, the return spring must provide sufficient force to overcome the inertia presented by these components in order to maintain the rocker arm cam follower in contact with the input cam lobe, and must be stiff enough to do so at relatively high engine-operating speeds. The design of a spring having sufficient force and stiffness, and yet small enough to fit within the limited space available in a modern engine, requires complex spring designs and relatively expensive materials. Moreover, the relatively large number of component parts and critical interfaces within a conventional VVA mechanism make their manufacture and assembly relatively complex, labor intensive and costly.

Therefore, what is needed in the art is a VVA mechanism that has fewer component parts and is therefore easier to manufacture and assemble.

Furthermore, what is needed in the art is a VVA mechanism that places little or no parasitic load upon the driving torque of the engine input/camshaft, and thereby improves engine power and fuel efficiency.

Moreover, what is needed in the art is a VVA mechanism that reduces the stiffness required of the return spring by reducing the effective mass of the components of the VVA, thereby enabling an increase in the maximum engine operating speed at which the VVA can be used.

SUMMARY OF THE INVENTION

The present invention provides a variable valve actuation mechanism that integrates the output cam and input cam follower into one body.

The present invention includes, in one form thereof, a control shaft assembly and a body. The control shaft assembly is pivotable relative to a pivot axis. The body is pivotally disposed on the control shaft assembly, and includes an input cam follower and at least one output cam surface. The input cam follower engages an input cam lobe, and the output cam surface engages a corresponding output cam follower. A spring engages the body and biases the input cam follower into engagement with the input cam lobe.

An advantage of the present invention is that there are fewer component parts and it is therefore easier to manufacture and assemble.

A further advantage of the present invention is that little or no parasitic load is imposed upon the driving torque of the engine input/camshaft, and engine power and fuel efficiency are thus improved.

A still further advantage of the present invention is that the stiffness required of the return spring is reduced due to a reduction in the effective mass of the components of the VVA.

An even further advantage of the present invention is that the reduced effective mass of the components enables use at higher engine operating speeds.

BRIEF DESCRIPTION OF THE DRAWINGS

The above-mentioned and other features and advantages of this invention, and the manner of attaining them, will become apparent and be better understood by reference to the following description of the embodiments of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
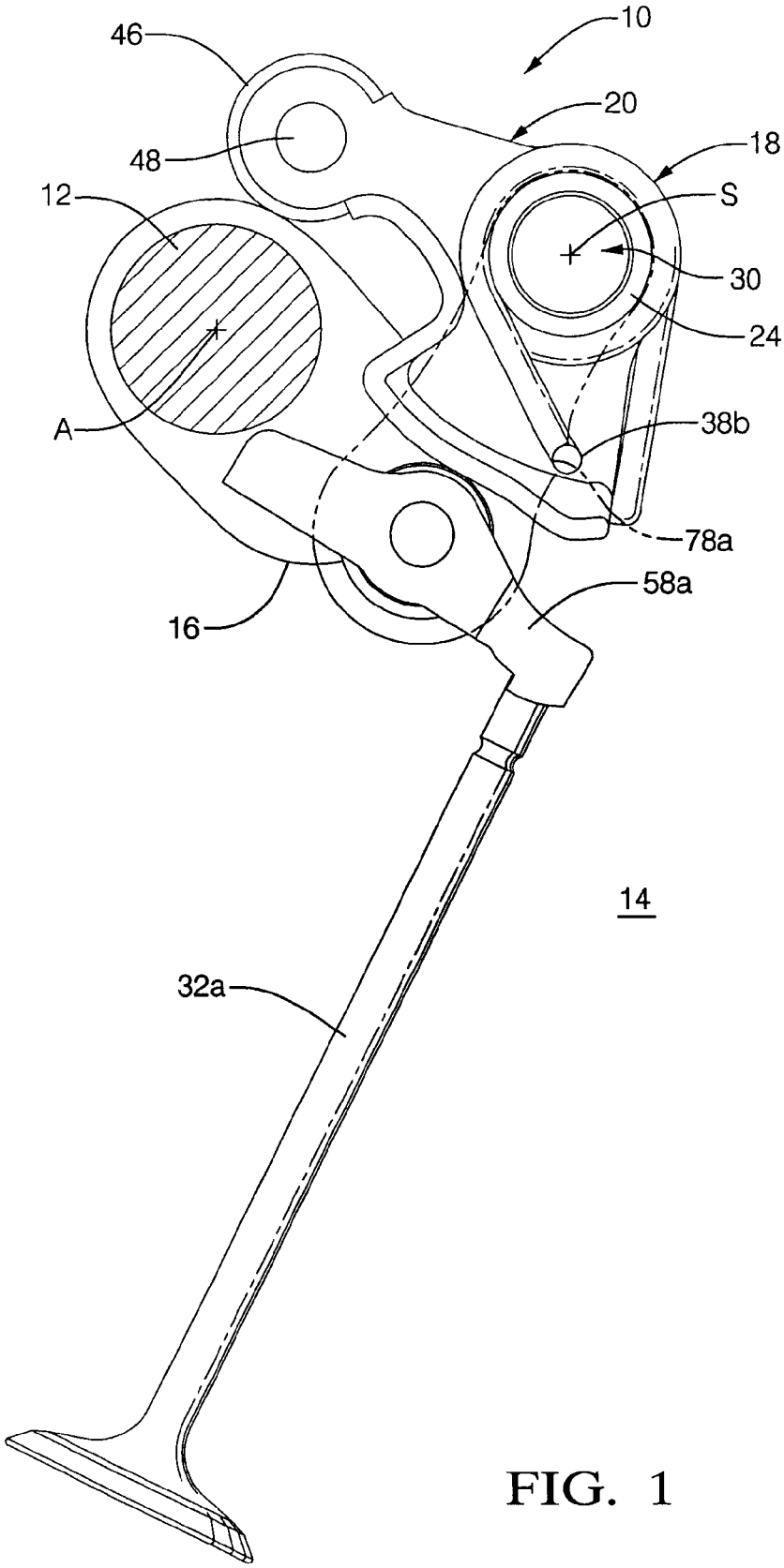
FIG. 1 is a side or end view of one embodiment of a Variable Valve Actuation (VVA) mechanism having an integrated rocker arm, input cam follower and output cam of the present invention in a full or substantially full-load position at a time prior to valve actuation.

Referring now to the drawings, and particularly to FIG. 1, there is shown one embodiment of a variable valve actuating (VVA) mechanism having an integrated rocker arm, input cam follower and output cam of the present invention in a full or substantially full-load position at a time prior to valve actuation. VVA mechanism 10 is operably installed in association with input shaft 12, such as, for example, a camshaft, of engine 14. Input shaft or camshaft 12 (hereinafter referred to as camshaft 12) is driven to rotate by and in timed relation to a crankshaft (not shown) of engine 14. Camshaft 12 rotates relative to central axis A thereof, and includes cam lobe 16 that rotates as substantially one body with camshaft 12.

VVA mechanism 10 includes spring 18, integrated input cam follower and output cam body 20, bearing insert 24, and control shaft assembly 30. Generally, and as is explained more particularly hereinafter, VVA mechanism 10 varies the valve lift of valves 32*a* and 32*b* (valve 32*b* shown in FIG. 8 and 9 only) dependent at least in part upon the angular position of control shaft assembly 30.

Figure 4:
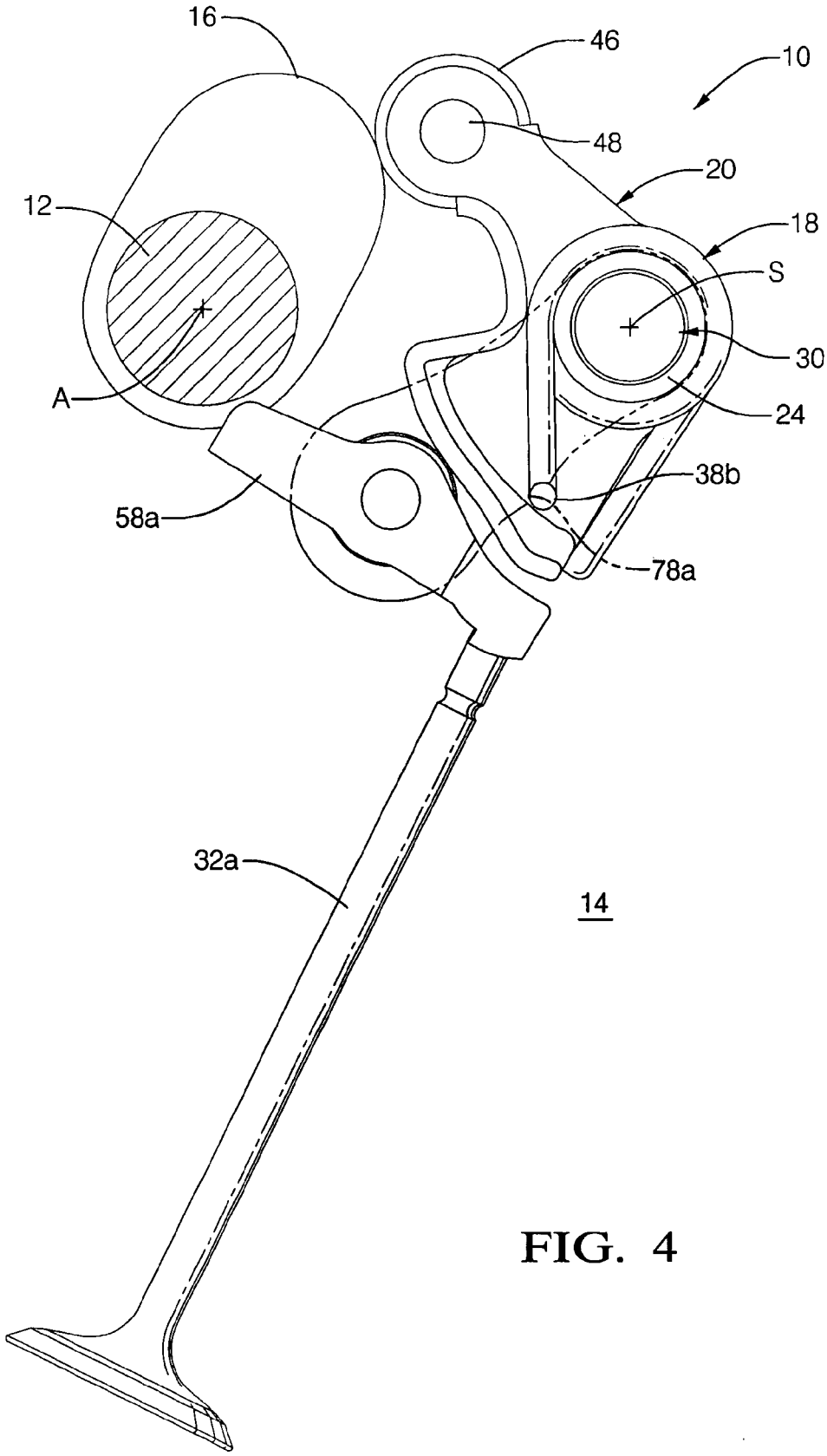
FIG. 4 is a side or end view of the VVA mechanism of FIG. 1 in a light-load position at approximately the time of or during valve actuation.
Figure 5:
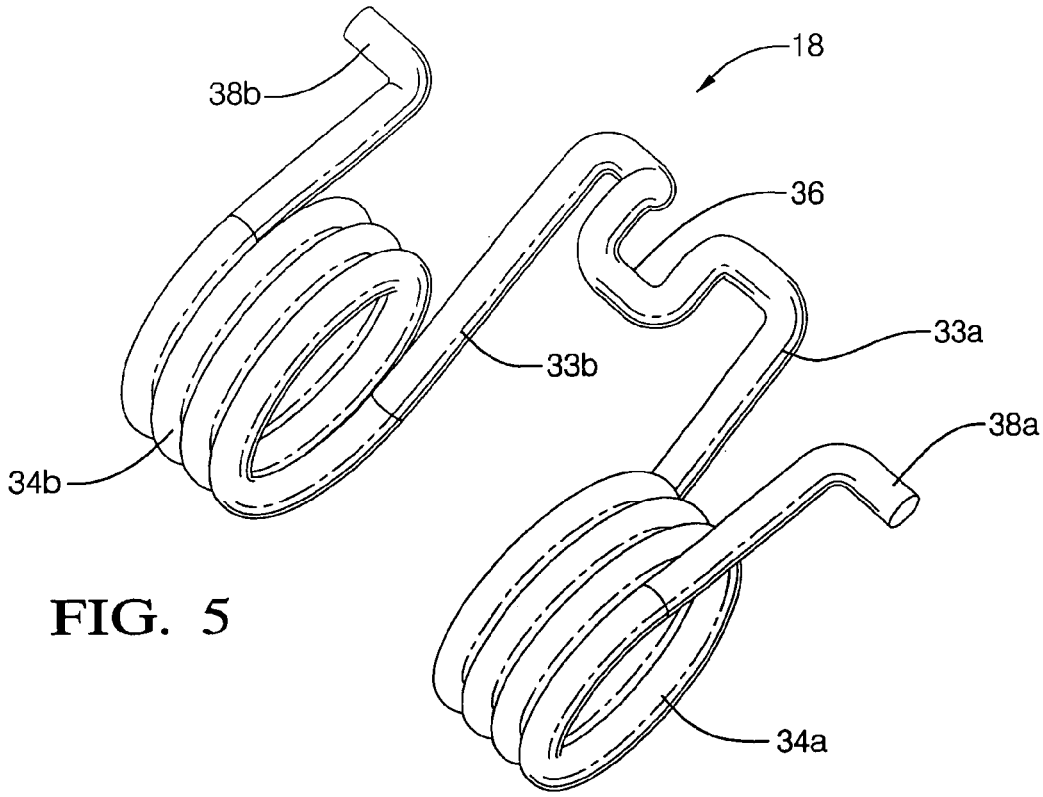
FIG. 5 is a perspective view of the spring of FIG. 1.

Spring 18, as best shown in FIG. 5, is configured as a double helical torsion spring, and includes arm portions 33*a*, 33*b* that extend in a generally tangential direction from coil portions 34*a* and 34*b*, respectively. Arm portions 33*a* and 33*b* form a central tab 36, and tabs 38*a* and 38*b* extend from coil portions 34*a*, 34*b*, respectively. As best shown in FIGS. 1–4, 8 and 9, and as will be more particularly described hereinafter, coil portions 34*a* and 34*b* are coiled around respective portions of control shaft assembly 30 and are disposed on opposite sides of integrated input cam follower and output cam body 20. As will also be more particularly described hereinafter, central tab 36 is grounded to integrated input cam follower and output cam body 20, and tabs 38*a* and 38*b* are grounded within corresponding features formed in respective portions of control shaft assembly 30.

Figures 7, 8:
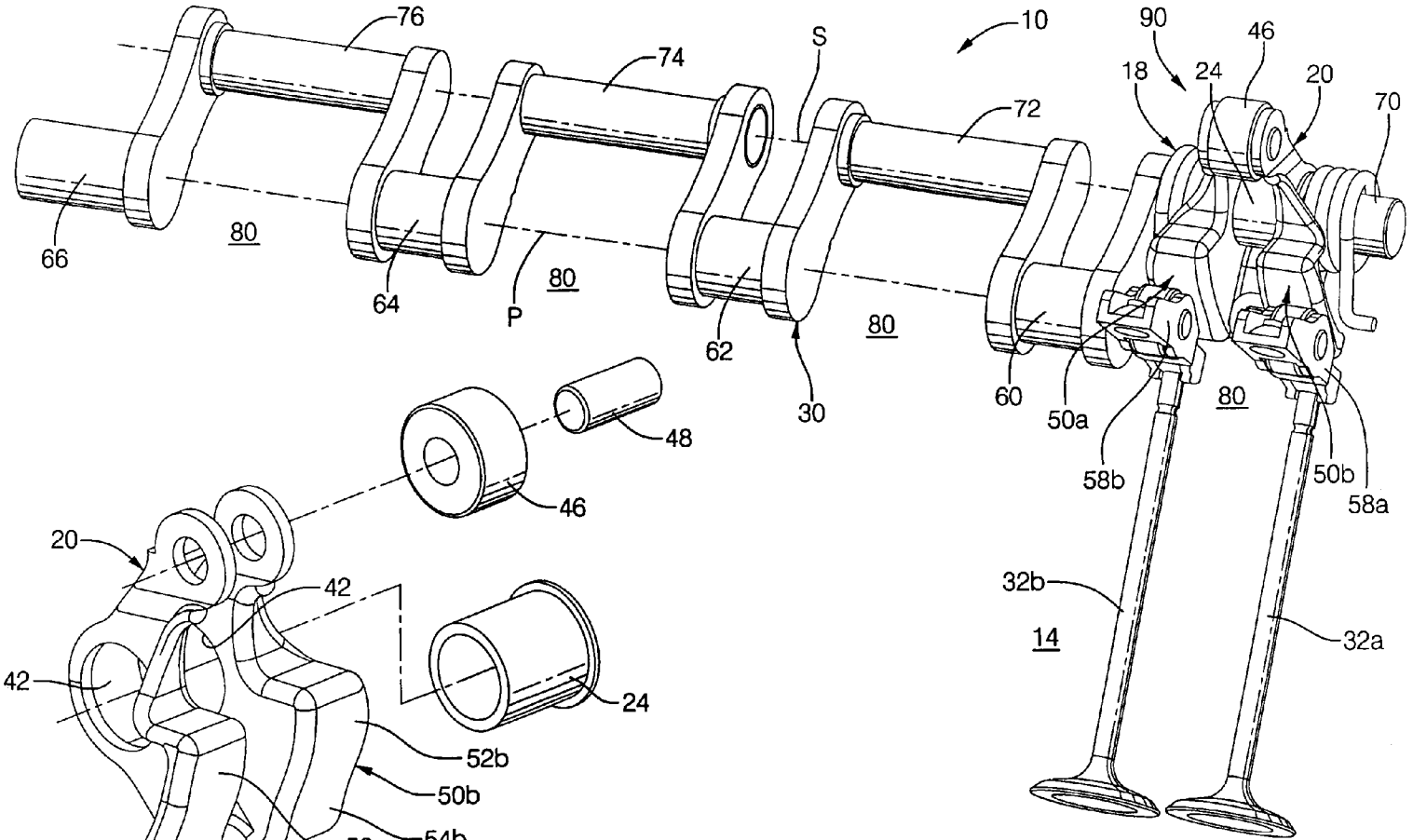
FIG. 7 is a perspective view of the integrated input cam follower and output cam body of the VVA mechanism of FIG. 1.
FIG. 8 is a perspective view of the VVA mechanism and control shaft assembly of FIG. 1.

Integrated input cam follower and output cam body 20 (hereinafter referred to as integrated body 20), as best shown in FIG. 7, defines orifice 42 within which bearing insert 24 is disposed. A portion of control shaft assembly 30, as will be more particularly described hereinafter, extends through bearing insert 24 and orifice 42 to thereby pivotally dispose integrated body 20 upon that portion of control shaft assembly 30. Input cam follower 46, such as, for example, a roller, is pivotally coupled by coupler 48, such as, for example, a pin, to integrated body 20.

Figure 6:
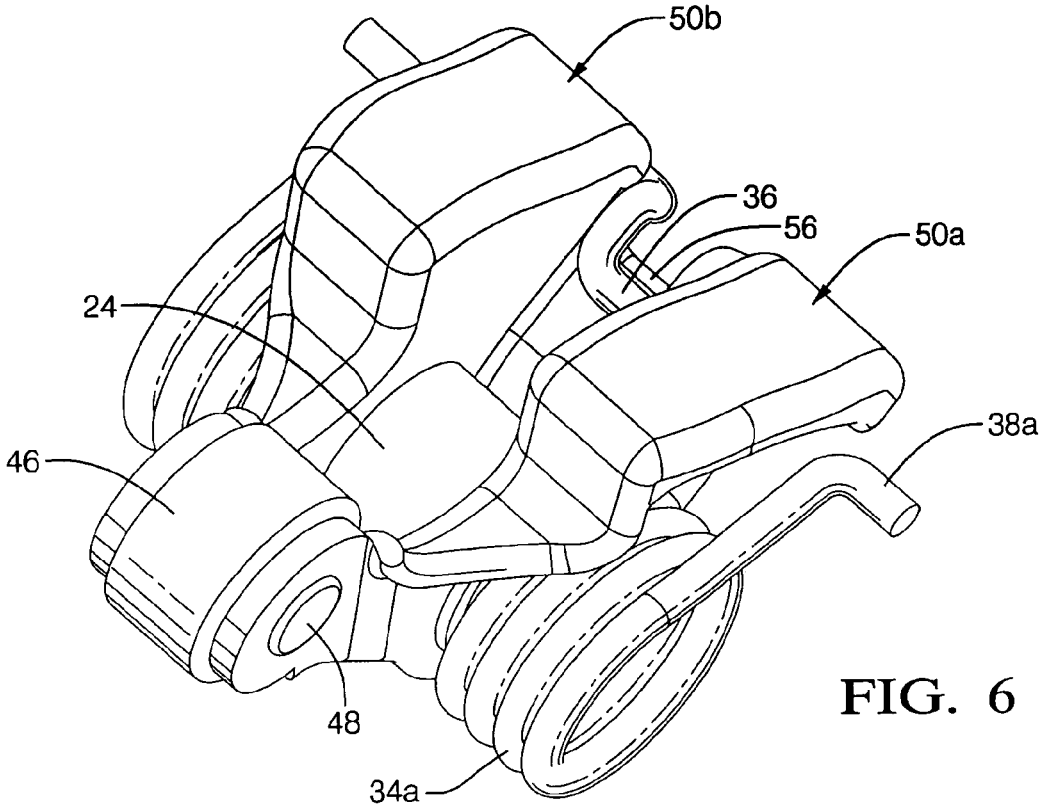
FIG. 6 is a perspective, bottom view of the VVA mechanism of FIG. 1.

Referring now to FIG. 6, integrated body 20 includes central recess 56, within which central tab 36 of spring 18 is disposed to thereby couple spring 18 to integrated body 20. Integrated body 20 further defines output cam surfaces 50*a* and 50*b* that include respective base circle/low-lift portions 52*a* and 52*b* (FIG. 7) and respective high-lift/nose portions 54*a* and 54*b* (FIG. 7) formed thereon, such as, for example, by grinding. Output cam surfaces 50*a* and 50*b* are disposed in engagement with a corresponding output cam follower 58*a* and 58*b* (FIG. 8), such as, for example, roller finger followers. Integrated body 20 is constructed of, for example, surface hardened low-carbon steel, and is formed by, for example, stamping.

Bearing insert 24, as discussed above, is disposed at least partially within orifice 42 of integrated body 20, and a portion of control shaft assembly 30 is disposed within and extends through bearing insert 24. Thus, bearing insert 24 is disposed and reduces friction between integrated body 20 and control shaft assembly 30. Bearing insert 24 is configured, such as, for example, a needle bearing assembly.

Figure 9:
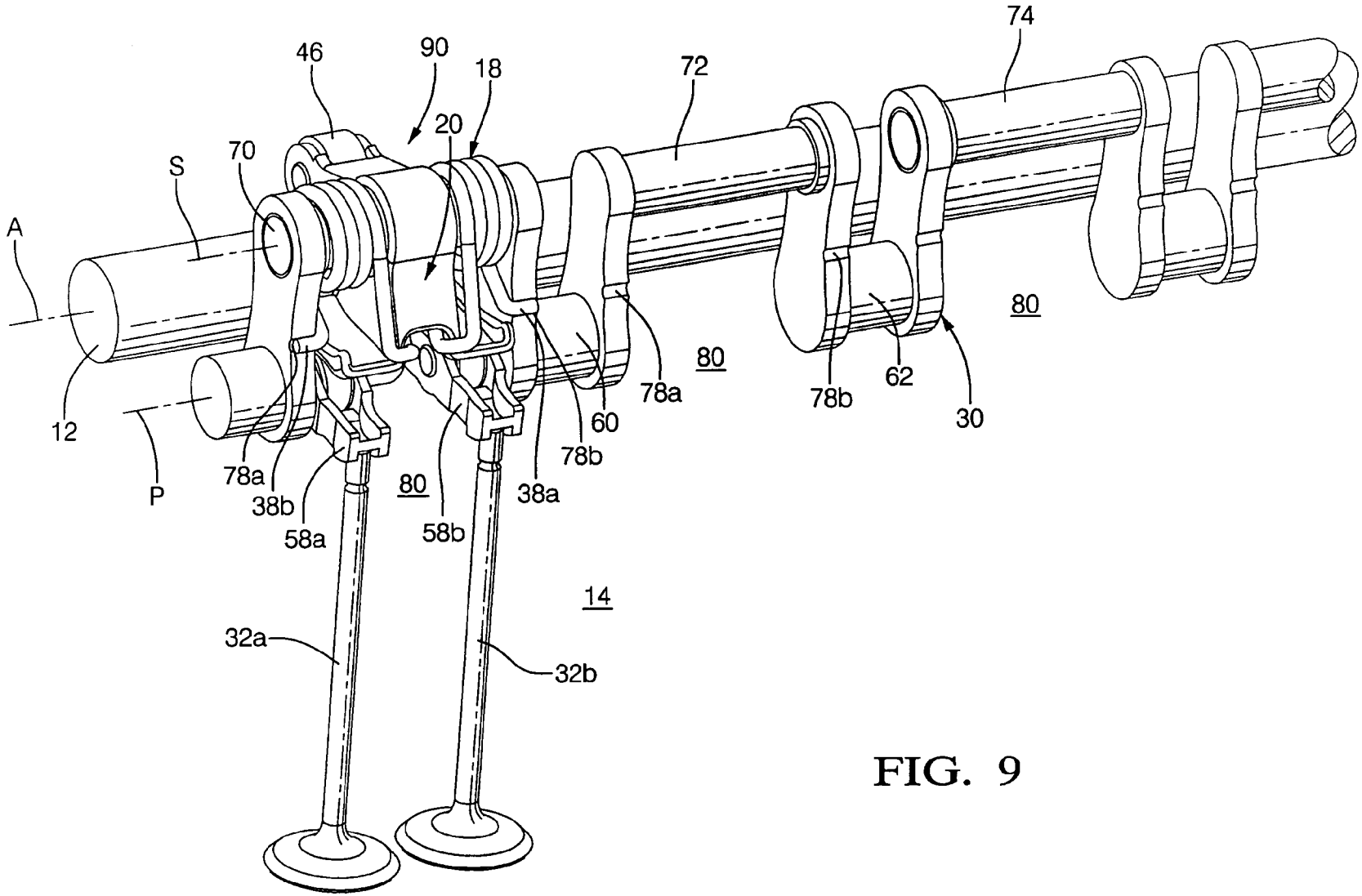
FIG. 9 is a detail view of FIG. 8.

Control shaft assembly 30, as best shown in FIG. 8 and 9, includes pivot segments 60, 62, 64 and 66 alternating in an axial direction and interconnected with shaft segments 70, 72, 74 and 76. Pivot segments 60, 62, 64 and 66 share a common central or pivot axis P, whereas shaft segments 70, 72, 74 and 76 share a common central or shaft axis S that is substantially parallel relative to and spaced apart from axis P. Pivot axis P and shaft axis S are each substantially parallel relative to and spaced apart from central axis A of input/camshaft 12 of engine 14. Control shaft assembly 30 is constructed and/or fabricated of, for example, forged steel or cast iron. An actuator (not shown) pivots control shaft assembly 30 relative to pivot axis P to thereby establish, as will be explained more particularly hereinafter, a desired valve lift profile.

Referring now to FIG. 9, each shaft segment 70, 72, 74 and 76 is disposed proximate to and associated with a corresponding one of the cylinders 80 of engine 14. A respective assembly of spring 18, integrated body 20 and bearing insert 24, hereinafter referred to as actuation assemblies 90, are associated with each of shaft segments 70, 72, 74 and 76, and thereby with each cylinder 80, to provide variable actuation of at least two of the valves of each cylinder 80 of engine 14. As stated above, spring 18 includes tabs 38*a* and 38*b* that are grounded within corresponding features formed in respective portions of control shaft assembly 30. More particularly, control shaft 30 defines spring-tab-receiving features 78*a* and 78*b*, such as, for example, grooves or orifices, within which tabs 38*a* and 38*b* are disposed, thereby grounding spring 18.

In use, input/camshaft 12 is driven to rotate in a counterclockwise direction and in timed relation to the crankshaft (not shown) of engine 14. Cam lobe 16 engages input cam follower 46 of integrated body 20. As input cam lobe 16 rotates from a position wherein its base circle portion engages input cam follower 46 (FIGS. 1 and 3) to a position in which its peak-lift or nose portion engages input cam follower 46 (FIGS. 2 and 4), integrated body 20 is caused to pivot in a clockwise direction relative to central shaft axis S. The pivoting of integrated body 20 causes output cam surfaces 50*a* and 50*b* to pivot relative to output cam followers 58*a* and 58*b*, respectively. Spring 18 biases integrated body 20 in a counterclockwise direction thereby biasing input cam follower 46 into engagement with input cam lobe 16.

The angular orientation of control shaft assembly 30 determines the lift profile, i.e., the amount of lift imparted to and the camshaft, angle at which the valve opening event occurs for that given amount of lift, of the associated valves of engine 14. More particularly, the angular orientation of control shaft 30 determines the portion of output cam surfaces 50*a* and 50*b* that engage cam followers 58*a* and 58*b*, respectively, during pivotal oscillation of integrated body 20. Further, the angular orientation of control shaft 30 also establishes the relative orientation of and the distance separating shaft axis S and central axis A. All of the aforementioned variables, i.e., the portion of output cam surfaces 50*a* and 50*b* that engage cam followers 58*a* and 58*b*, respectively, during pivotal oscillation of integrated body 20, and the relative orientation of and the distance separating shaft axis S and central axis A, conjunctively determine the valve lift profile.

Figure 2:
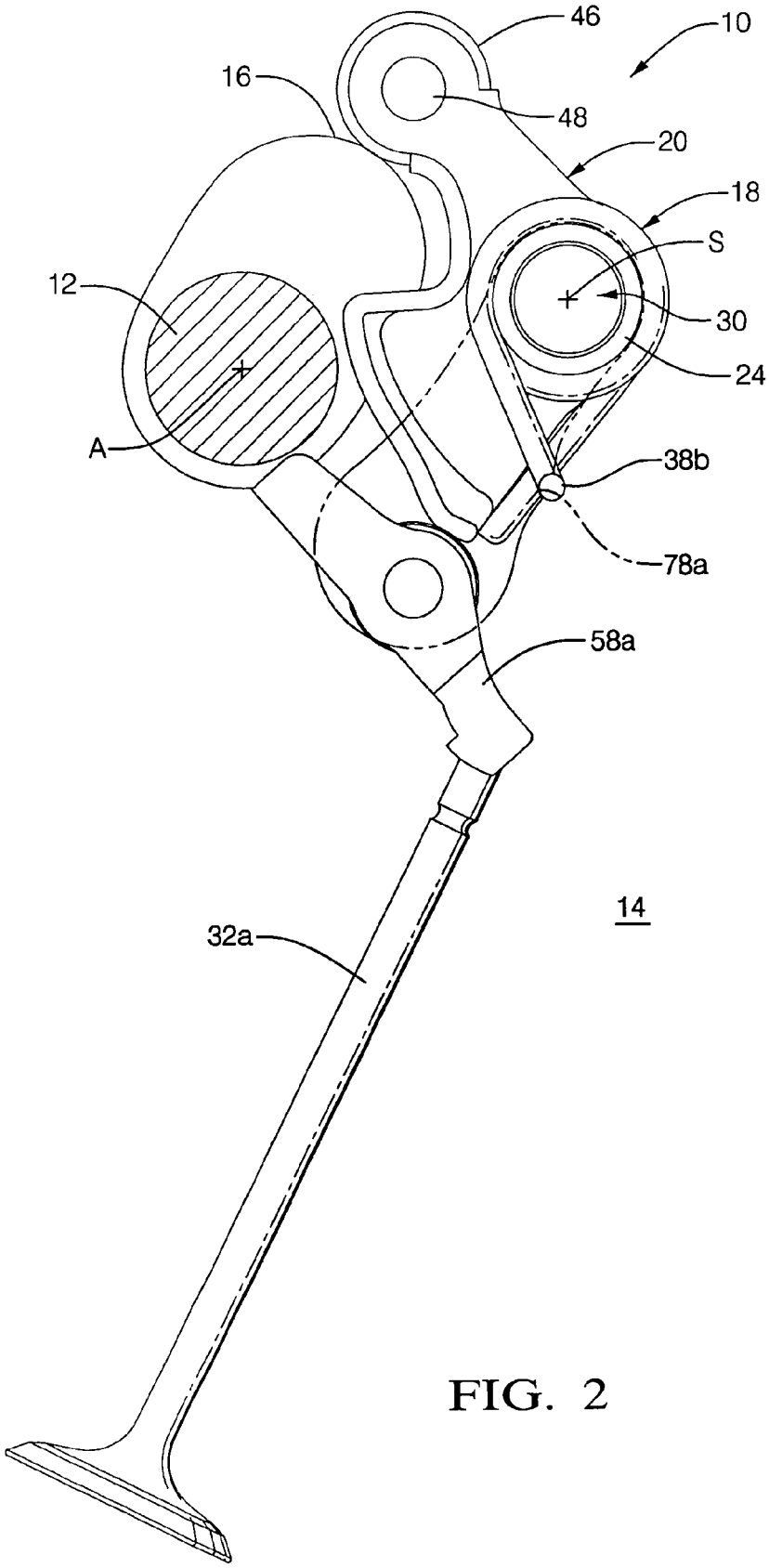
FIG. 2 is a side or end view of the VVA mechanism of FIG. 1 in a full or substantially full-load position at approximately the time of or during valve actuation.

With control shaft 30 oriented to dispose VVA mechanism 10 in the full or substantially full load orientation as shown in FIGS. 1 and 2, output cam surfaces 50*a*, 50*b* are disposed such that substantially all of lift portions 54*a* and 54*b*, respectively, are disposed within the fixed oscillatory range of movement of integrated body 20 relative to output cam followers 58*a* and 58*b*, respectively. Thus, as integrated body 20 is pivotally oscillated, substantially the entire lift portions 54*a* and 54*b* engage output cam followers 58*a* and 58*b*, respectively, and a high or substantially maximum amount of lift is imparted to the valves of engine 14.

Figure 3:
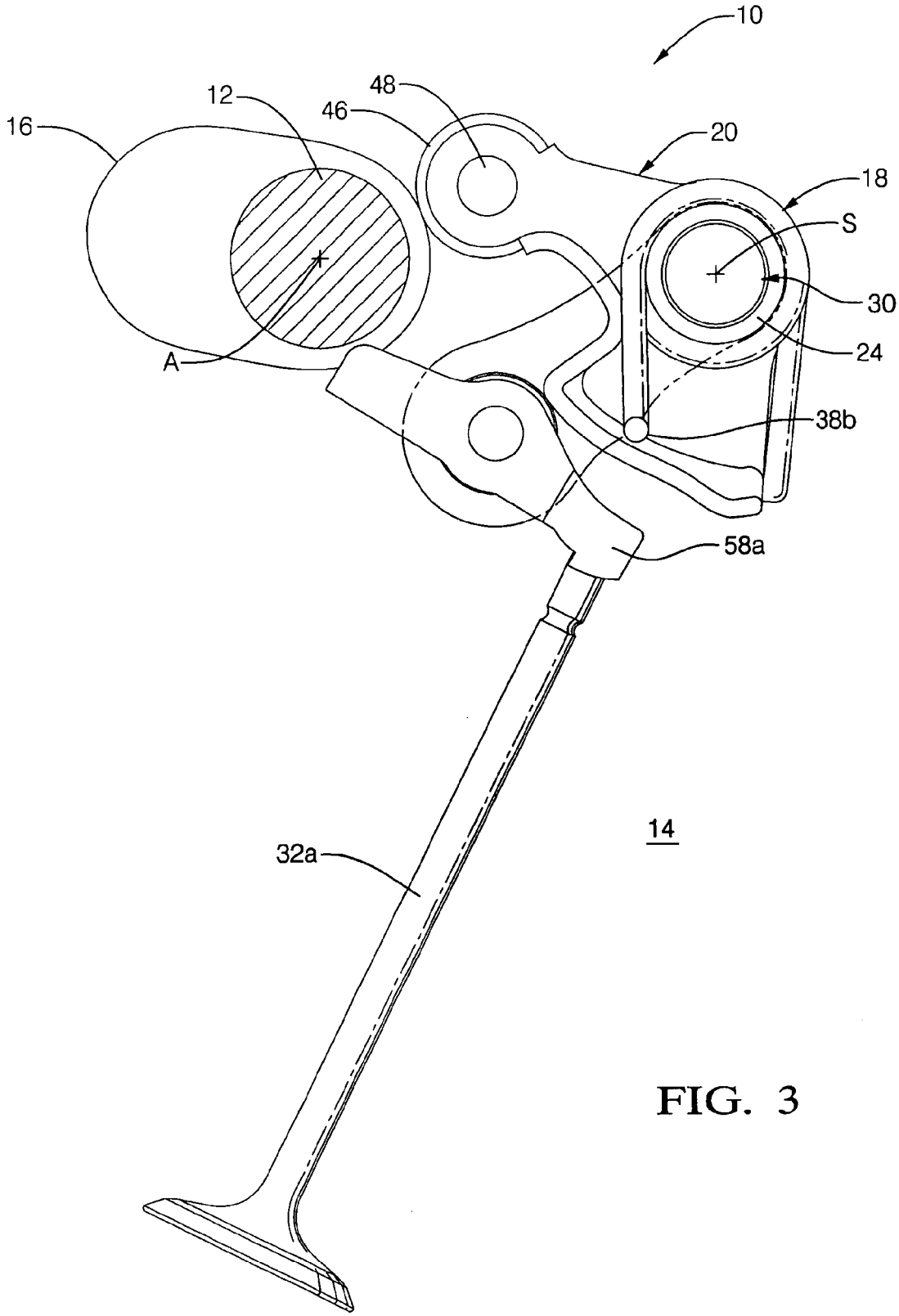
FIG. 3 is a side or end view of the VVA mechanism of FIG. 1 in a light-load position at a time prior to valve actuation.

Conversely, with control shaft 30 oriented to dispose VVA mechanism 10 in the low-load orientation as shown in FIGS. 3 and 4, output cam surfaces 50*a* and 50*b* are disposed such that substantially none of the lift portions 54*a* and 54*b*, respectively, are disposed within the fixed oscillatory range of movement of integrated body 20 relative to output cam followers 58*a* and 58*b*. Thus, as integrated body 20 is pivotally oscillated, output cam followers 58*a* and 58*b* are engaged only or substantially only by the base circle or low lift portions 52*a* and 52*b*, and a low or substantially minimum amount of lift is imparted to the valves of engine 14.

As stated above the pivoting of control shaft assembly 30, in addition to orienting output cam surfaces 50*a* and 50*b* relative to cam followers 58*a* and 58*b*, respectively, establishes the relative orientation of and the distance separating shaft axis S and central axis A. As control shaft assembly 30 is pivoted relative to pivot axis P, pivot segments 60, 62, 64 and 66 undergo substantially pure pivotal movement relative to pivot axis P. As pivot segments 60, 62, 64 and 66 are pivoted relative to pivot axis P they do not move substantially toward or away from input shaft 12. Conversely, since shaft segments 70, 72, 74 and 76 are substantially concentric relative to shaft axis S but are eccentric relative to pivot axis P, shaft segments 70, 72, 74 and 76 move in a generally arced manner and in a direction generally toward and/or away from input/camshaft 12 as control shaft assembly 30 is pivoted relative to pivot axis P.

The movement of shaft segments 70, 72, 74 and 76 generally toward and/or away from input shaft 12 and/or central axis A thereof is best seen by comparing the orientation of shaft axis S of shaft segments 70, 72, 74 and 76 relative to central axis A of input/camshaft 12 shown in FIGS. 1 and 2 with the orientation of shaft axis S relative to central axis A as shown in FIGS. 3 and 4. More particularly, as shown in FIGS. 1 and 2 wherein VVA mechanism 10 is depicted in the high-load position, shaft axis S and central axis A are at a minimum or substantially minimum relative separation and are oriented in a generally horizontal plane relative to each other.

Conversely, as shown in FIGS. 3 and 4 wherein VVA mechanism 10 is depicted in the low-load position, control shaft 30 has been pivoted from approximately twenty (20°) to approximately thirty (30°) degrees in a clockwise direction from the high-load orientation shown in FIGS. 1 and 2 and, as a result of this clockwise pivoting of control shaft 30, shaft axis S and central axis A are separated by a maximum or substantially maximum distance. Further, the two axes no longer occupy a generally horizontal plane. Rather, shaft axis S has moved down and away from central axis A, and the two axes now occupy a plane that is at an angle of approximate two (2°) to approximately three (3°) degrees below horizontal.

The separation between and orientation of shaft axis S relative to central axis A determine the portion of the lift profile of input cam lobe 16 that is in engagement with input cam follower 46 at a given angle of rotation of input/camshaft 12, and thereby determine at least in part the timing or phasing of the valve opening event relative to the angle of input/camshaft 12 rotation. Further, the separation between and orientation of shaft axis S relative to central axis A determine at least in part the orientation of integrated body 20 relative to output cam followers 58*a*, 58*b*, and thereby determine which portions of output cam surfaces 50*a*, 50*b* engage cam followers 58*a*, 58*b*, respectively, during pivotal oscillation of integrated body 20. Thus, the separation between and orientation of shaft axis S relative to central axis A as determined by the angular orientation of control shaft assembly 30 determine the valve lift profile.

Figure 10:
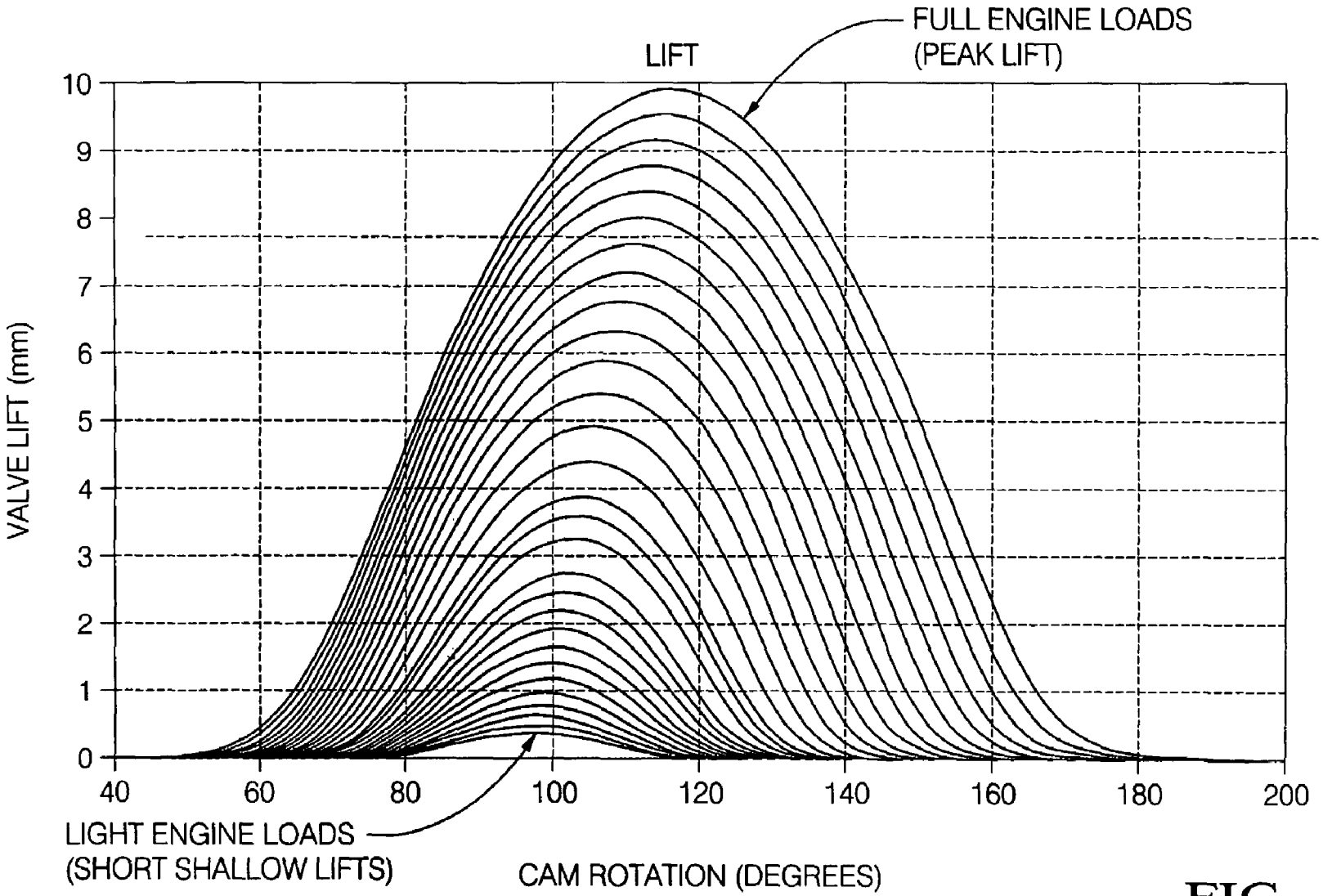
FIG. 10 is a plot of an exemplary family of valve lift profiles obtained with the VVA mechanism of the present invention.

It should be particularly noted that control shaft assembly 30 is pivoted in a substantially continuous manner between the maximum-lift or full-load orientation (FIGS. 1 and 2) and low-load orientation (FIGS. 3 and 4) to thereby provide substantially continuous adjustment of the amount of lift imparted to the valves of engine 14, as depicted by the exemplary family of valve lift curves shown in FIG. 10.

In the embodiment shown, input cam follower 46 is configured as a roller that is pivotally coupled by coupler 48, such as, for example, a pin, to integral body 20. However, it is to be understood that integral body 20 can be alternately configured, such as, for example, with a slider-pad-type cam follower that is integral and monolithic with and/or otherwise attached to integral body 20.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A variable valve actuation mechanism, comprising:

a control shaft assembly pivotable relative to a pivot axis;

a body pivotally disposed on said at least one control shaft assembly, said body including an input cam follower and at least one output cam surface, said input cam follower configured for engaging an input cam lobe, said at least one output cam surface configured for engaging a corresponding output cam follower, wherein said at least one output cam surface comprises a base circle portion and a lift portion; and a spring engaging said body for biasing said input cam follower into engagement with the input cam lobe.

2. An engine having a rotary camshaft with a central axis and at least one input cam lobe, said engine comprising:

a variable valve actuation mechanism including a control shaft assembly having at least one shaft segment with a shaft axis and at least one pivot segment with a pivot axis, said shaft axis being substantially parallel relative to and spaced apart from said pivot axis, each of said pivot and said shaft axes being substantially parallel relative to and spaced apart from the central axis of the camshaft, said control shaft assembly being pivotable relative to said pivot axis, an integrated body pivotally disposed on said at least one shaft segment, said integrated body including an input cam follower and at least one output cam surface, said input cam follower engaging the input cam lobe, said at least one output cam surface engaging a corresponding output cam follower of the engine, and a spring engaging said integrated body and biasing said input cam follower into engagement with the input cam lobe.

3. The variable valve actuation mechanism of claim 2, wherein each said at least one output cam surface comprises a base circle portion and a lift portion.

4. The variable valve actuation mechanism of claim 2, wherein each said at least one output cam surface is integral and monolithic with said integrated body.

5. The variable valve actuation mechanism of claim 2, wherein said integrated body defines an orifice therethrough, at least a portion of said shaft segment being received within said orifice.

6. The variable valve actuation mechanism of claim 5, further comprising a bearing insert disposed within said orifice, said portion of said shaft segment being received within said bearing insert.

7. The variable valve actuation mechanism of claim 2, wherein said input cam follower comprises a roller pivotally coupled to said integrated body.

8. The variable valve actuation mechanism of claim 2, wherein said spring comprises a torsion spring having first and second coils, first and second arm portions extending from said first and second coils, respectively, said first and second coils disposed on respective and opposite sides of said integrated body, said shaft segment extending through said first and second coils.

9. The variable valve actuation mechanism of claim 2, wherein said control shaft assembly further includes spring-tab-receiving features, said arms further comprising respective tabs, each of said tabs being received at least partially within said spring-tab-receiving features.

10. The variable valve actuation mechanism of claim 9, wherein said spring-tab-receiving features comprise one of grooves and orifices.

11. The variable valve actuation mechanism of claim 9, wherein said integrated body defines a central recess, said spring arms conjunctively defining a central tab, said central tab engaging said central recess.

12. A variable valve actuation mechanism for use with an engine, said engine including a rotary camshaft having a central axis and at least one input cam lobe, said mechanism comprising:

a control shaft assembly including at least one shaft segment having a shaft axis and at least one pivot segment having a pivot axis, said shaft axis being substantially parallel relative to and spaced apart from said pivot axis, each of said pivot and said shaft axes being substantially parallel relative to and spaced apart from the central axis of the camshaft, said control shaft assembly being pivotable relative to said pivot axis;

an integrated body pivotally disposed on said at least one shaft segment, said integrated body including an input cam follower and at least one output cam surface, said input cam follower configured for engaging the input cam lobe, said at least one output cam surface configured for engaging a corresponding output cam follower of the engine; and a spring engaging said integrated body and configured for biasing said input cam follower into engagement with the input cam lobe.

13. The variable valve actuation mechanism of claim 12, wherein each said at least one output cam surface comprises a base circle portion and a lift portion.

14. The variable valve actuation mechanism of claim 12, wherein each said at least one output cam surface is integral and monolithic with said integrated body.

15. The variable valve actuation mechanism of claim 12, wherein said integrated body defines an orifice therethrough, at least a portion of said shaft segment being received within said orifice.

16. The variable valve actuation mechanism of claim 15, further comprising a bearing insert disposed within said orifice, said portion of said shaft segment being received within said bearing insert.

17. The variable valve actuation mechanism of claim 12, wherein said input cam follower comprises a roller pivotally coupled to said integrated body.

18. The variable valve actuation mechanism of claim 12, wherein said spring comprises a torsion spring having first and second coils, first and second arm portions extending from said first and second coils, respectively, said first and second coils disposed on respective and opposite sides of said integrated body, said shaft segment extending through said first and second coils.

19. The variable valve actuation mechanism of claim 12, wherein said control shaft assembly further includes spring-tab-receiving features, said arms further comprising, respective tabs, each of said tabs being received at least partially within said spring-tab-receiving features.

20. The variable valve actuation mechanism of claim 19, wherein said spring-tab-receiving features comprise one of grooves and orifices.

21. The variable valve actuation mechanism of claim 19, wherein said integrated body defines a central recess, said spring arms conjunctively defining a central tab, said central tab engaging said central recess.

* * * * *